United States Patent [19]

Baumbach

[11] 4,020,823

[45] May 3, 1977

[54] HOT AIR HEATING SYSTEM

[76] Inventor: Roger J. Baumbach, 3267 Belfast, Flint, Mich. 48507

[22] Filed: Aug. 11, 1975

[21] Appl. No.: 603,714

[52] U.S. Cl. ..... 126/121; 98/115 VM; 165/128; 237/51

[51] Int. Cl.[2] ..... F24B 7/04

[58] Field of Search ..... 126/99 R, 116 R, 121; 237/51, 53; 98/115 VM; 165/128

[56] References Cited

UNITED STATES PATENTS

| | | | |
|---|---|---|---|
| 75,097 | 3/1868 | Whorf | 126/99 R |
| 294,854 | 3/1884 | Comstock | 165/128 |
| 767,097 | 8/1904 | Beard | 126/99 R |
| 1,676,054 | 7/1928 | Satterholm | 126/116 R |
| 1,987,252 | 1/1935 | Cage | 126/121 |
| 2,108,033 | 2/1938 | Cooper | 126/116 R X |
| 2,471,351 | 5/1949 | Russell | 237/51 |

*Primary Examiner*—William E. Wayner
*Assistant Examiner*—William E. Tapolcai, Jr.
*Attorney, Agent, or Firm*—Harry R. Dumont

[57] ABSTRACT

The hot air from a primary combustion chamber is passed through a specialized heat exchange enclosure unit which contains a plurality of spaced, substantially vertically oriented conduits having their upper and lower ends in communication with ambient air. The enclosure receives heated air from the combustion chamber at one side and exhausts smoke and depleted gases at the other side.

4 Claims, 8 Drawing Figures

FIG. 6
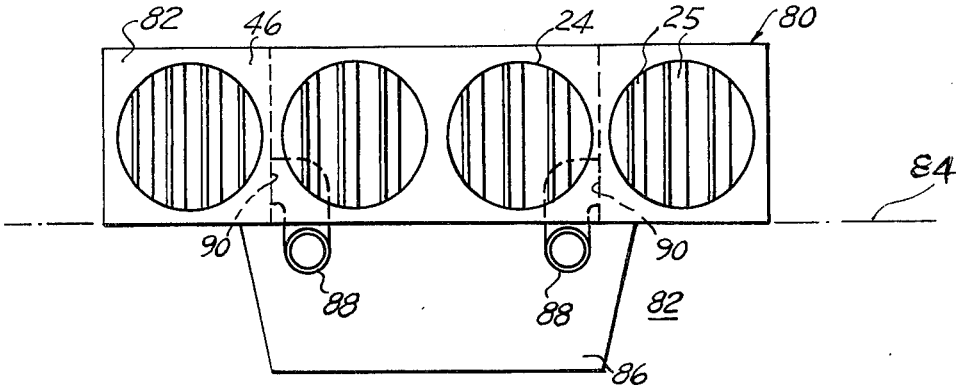
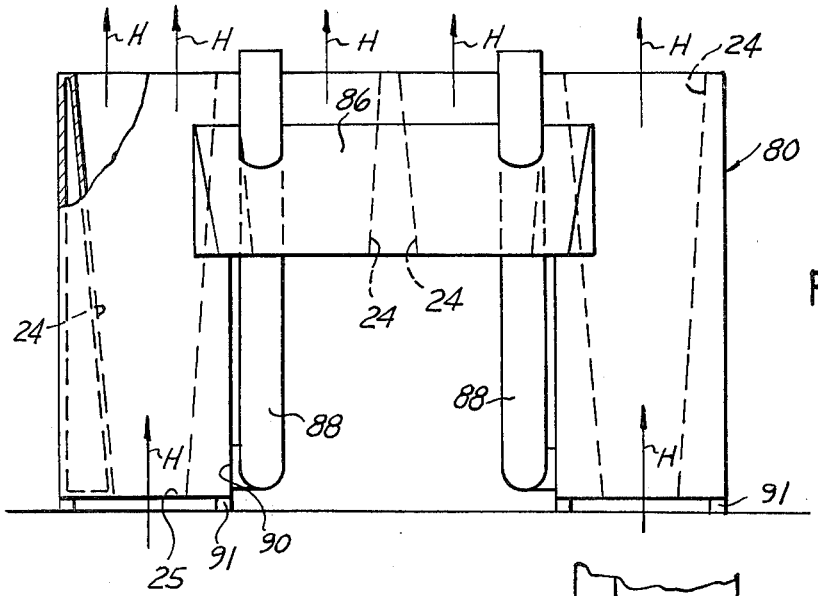
FIG. 7
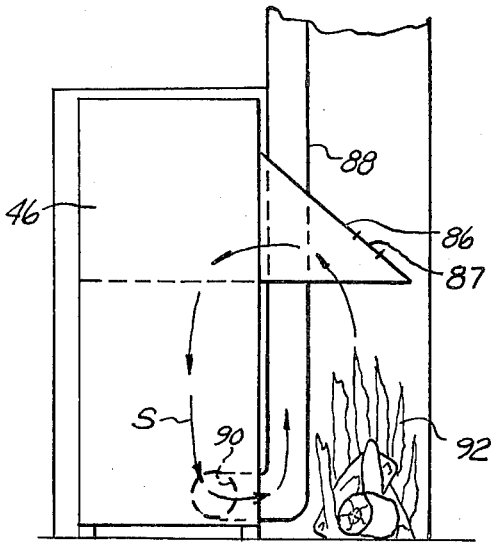
FIG. 8

HOT AIR HEATING SYSTEM

FIELD OF THE INVENTION

The present invention relates to heating systems and includes a heat exchange unit for providing heat transfer from one hot gas source to another gas in such manner as to promote clean and efficient hot air output. The system may be incorporated either integrally into a hot air furnace for heating buildings or it may be included separately in the hot air exhaust pipe from a different heating unit, such as a space heater or a fireplace in which the primary combustion chamber is formed in a wall opening.

BACKGROUND OF THE INVENTION

In hot air furnaces, it is customary to use a furnace which is located on the lower level of the dwelling or building such that the hot air from the furnace is permitted to rise, while the cold air is typically returned in a cold air return system to the furnace through cold air return ducts. In order to expedite the transfer of heated air throughout the building, it is customary to use a system of one or more fans in conjunction with the furnace. This is a relatively expensive approach, particularly in view of the increasing cost of electric power, and further represents a substantial cost addition to the furnace in its initial construction, installation and servicing.

The present invention relates to a unit in which ambient air is taken from about the furnace or from an intake connected to ambient air outside the building. The air is permitted to rise through the tubes or conduits which are arranged in a spaced array in the furnace. Air is taken in at the bottoms of the tubes at substantially ambient temperature, exhausted upwardly through the tubes and, responsive to the heating effect of exiting hot gas in the primary combustion chamber, the rapid flow upwardly of elevated temperature air through the conduits occurs. In this manner, there is provided a rapid and efficient gas to gas heat transfer.

In one embodiment of the invention, the tubes have their upper ends communicating with a hot air exit pipe formed at the top of the furnace shell. Thus, there is a lateral flow not only of the hot air leaving the primary combustion chamber but also a more important flow of hot air exiting from each open upper end of the several conduits. The lateral flow of heated gases and smoke mixed with noxious gases from the primary combustion chamber passes through the conduit interstices with a final passage outwardly through an exiting exhaust pipe. This pipe communicates with a chimney or other elevated outlet to provide for eliminating the gas and smoke from the building or dwelling itself.

In an alternate embodiment of the invention, certain of the basic elements just described in connection with the furnace are incorporated in a separate enclosure which is then joined in the hot air exhaust line of a separate combustion chamber such as, for example, that from a space heater or from a fireplace of the conventional type. The basic operation of the unit with respect to the separate enclosure unit is substantially as just described for the furnace embodiment in that there is provided a lateral flow of smoke and noxious gases which then goes to the exit or smoke pipe, while at the same time there is provided flow through a large number of separate vertically spaced conduits in a vertical direction so that the greatest possible amount of heat is conveyed not only by radiation from the primary combustion unit itself, but through the gases which are drawn from ambient, passed upwardly, finally emerging in the heated condition.

Other systems are known to the prior art in which heat transfer is provided through separate hot air chutes or separate tubes in such manner as to in various ways pass heat gas-to-gas to improve the efficiency of the heating unit. One example of this general class of system is shown in Stookey U.S. Pat. No. 3,129,931 issued on Apr. 21, 1964 for "Recuperator". The recuperator disclosed in that patent shows a system for effecting heat exchange between two gaseous media, but the basic system of Applicant and the incorporation of such a system in connection with a furnace, fireplace or the like in the manner in which the combination of Applicant operates is not shown.

The use of vertical or inclined tubes in heating systems has been shown generally in the following patents: Miller et al U.S. Pat. No. 3,223,078 issued Dec. 14, 1965 for "Warm Air Furnace" and Bassett et al U.S. Pat. No. 2,283,407 issued May 19, 1942 for "Heater".

The prior art, including the aforementioned patents, does not teach or make possible a heating system such as that of Applicant in which there is eliminated the need for fans and forced air circulation, but rather which operates on a gravity basis, amplifying the efficiency of standard hot air furnace of the gravity type by providing the conduit arrangement and enclosure positioned, constructed and connected in the manner taught by Applicant.

SUMMARY OF THE INVENTION

The present invention thus relates to a heat exchanger enclosure with vertically spaced conduits, preferably of the metallic type, with inlets and outlets and with their intermediate portions in communication with the hot air exhausted from a primary combustion chamber in such manner as to laterally separate smoke and noxious gases from the primary combustion chamber and at the same time promote upward escape and flow of the desired hot air, which in a heated condition will rise and provide heating to the building or dwelling in which the system is used.

An alternate embodiment of the invention includes an integrally formed enclosure and conduits which, if properly positioned and coupled in the hot air flow, again would provide gas-to-gas heat transfer with considerable amplification of the heating efficiency of the system over that which would be expected from a normal hot air gravity heating system.

A still further embodiment of the invention includes a separately formed adjunct which is usable in connection with a standard fireplace in such manner as to obtain the maximum heat output from the fireplace and convert it to a warm air heating system which provides rapid and efficient heating to the adjacent rooms of the dwelling. In addition, there is provided a system for removing the smoke and gaseous byproducts of the combustion process through the normal fireplace hot air exit system.

BRIEF DESCRIPTION OF THE DRAWINGS

In the accompanying drawings wherein like reference characters designate like parts throughout the several views:

FIG. 6 is a top plan view of a still further embodiment of the present invention in which a heating adjunct is provided for use with a standard fireplace heating unit;

FIG. 7 is a rear elevation view of the heating adjunct as it is positioned relative to a standard fireplace; and FIG. 8 is a left side view of the adjunct showing it in its operative position relative to the fireplace.

DETAILED DESCRIPTION OF THE PREFERRED EMBODIMENT

Figure 1:
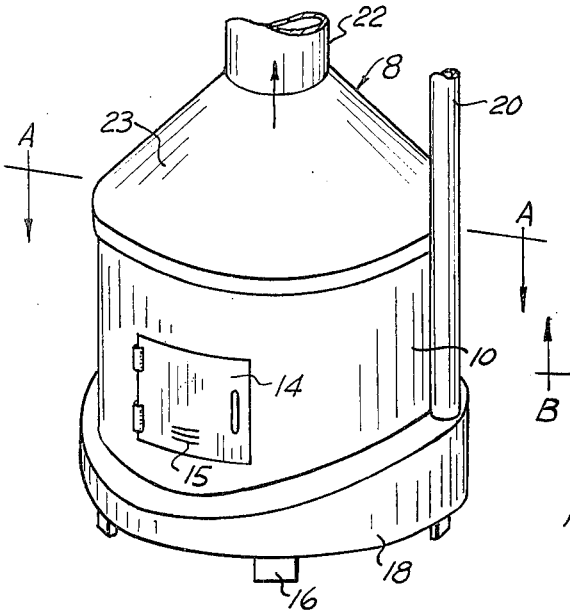
FIG. 1 is a partial perspective view showing the preferred embodiment of the invention in a hot air furnace.

With reference to FIG. 1, there is shown the preferred embodiment of the present invention which is incorporated in a gravity hot air type furnace 8. Included in the system is an external shell 10 which encloses interiorly a primary combustion chamber 12 that will be shown in greater detail in FIGS. 2 and 3 hereinafter. The furnace 8 further includes a front fire door 14 used to add fuel or to service the fuel burning parts of the primary combustion chamber 12. It will be seen that the furnace 8 is mounted on extended legs 16 which allow for the flow toward the bottom of the furnace of ambient air. Also included in the construction of the furnace 8 is a circular collector of a rectangular cross-sectional type, namely collector 18. It will be seen that collector 18 is of a generally divergent shape in the direction of an exhaust or exit pipe 20. The exit pipe 20 is generally connected at its upper end to a chimney or the like element, not shown, to remove smoke and other noxious gases and exhausts which may arise from the combustion of gas or other fuel in the primary combustion chamber 12. The general path of heated air is upwardly, as indicated in FIG. 1 by an arrow proximate the top of the drawing. The heated air is further passed into and through a hot air pipe 22 at the top of the furnace 8 which, in a manner well known to the art, is further connected to one or more heat pipes for conveying the heated air upwardly and then laterally to heat ducts in the rooms which are located above the furnace 8. The present heating system, it will be seen, thus is incorporated in a hot air system of the basic gravity type in which the heated air rises to heat upwardly located and remote parts of the building.

Figure 2:
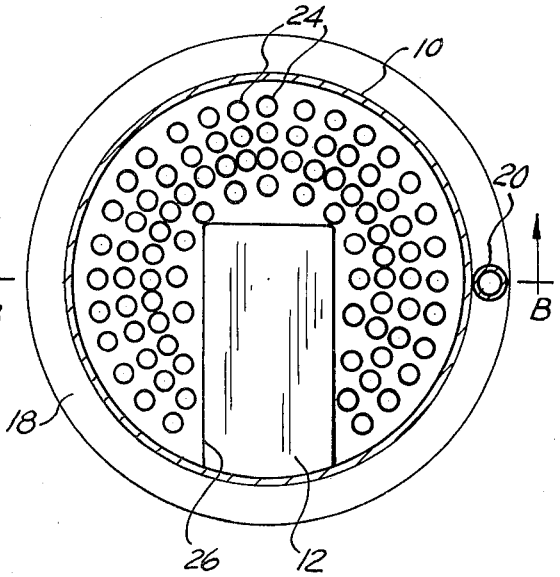
FIG. 2 is a cross-sectional view along the section line A—A of FIG. 1 showing the detail of the major internal parts.

As shown in FIG. 2, there is included within the furnace shell 10 a plurality of heating conduits 24 which are mounted in an array spaced one from the other so as to provide free passage of air therebetween in a path which may be described as being laterally directed toward the inlet port 19 to the exit pipe 20 which communicates between the collector 18 and a chimney or similar construction for providing egress of the smoke and waste gases from the combustion chamber 12. It will be understood that the collector 18, while it is shown as having a uniform cross-sectional area proximate its base, further extends laterally and upwardly as better shown in FIG. 1 to promote the flow of air therethrough, carrying smoke and exhaust noxious gases to the pipe 20.

The primary combustion chamber 12, while it is illustrated as being of a generally rectangular configuration, is not so limited and actually the cross-sectional shape and sizing of it may vary.

Figure 3:
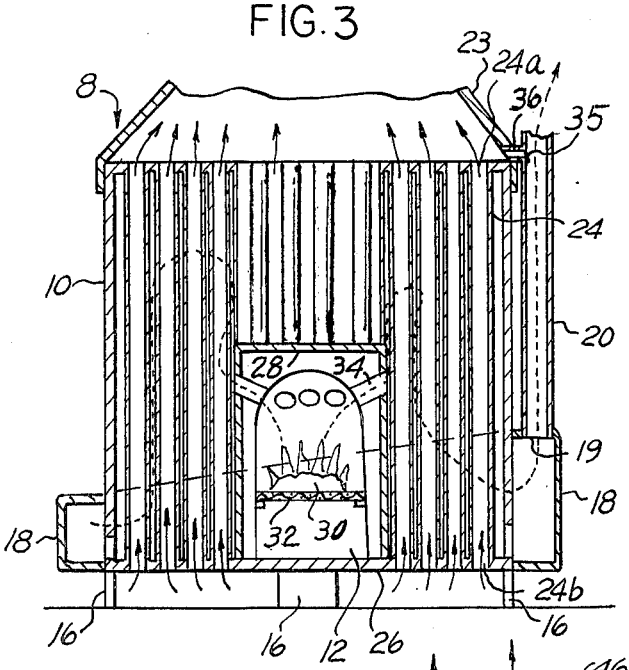
FIG. 3 is a vertical half-sectional view taken along section lines B—B of FIG. 2 further showing the detail of the internal construction of the furnace.

FIG. 3 shows in greater detail the construction of the plurality of conduits 24 which are held in the vertically disposed array with the shell 10 of the furnace 8. Also shown in FIG. 3 is the shape of the collection dome 23 which finally communicates with the hot air exit pipe 22 as best shown previously in FIG. 1. FIG. 3 further shows the internal construction and the parts within the primary combustion chamber 12. Included in the chamber 12 are sidewalls 26 and an upper lid portion 28. The fuel 30 being burned is suitably carried on a grate or support 32. Any type of suitable fuel, that is, liquid, gas or solid, may be used in conjunction with the present invention. To provide air to promote combustion of the fuel 30, the door 14 may be provided with slots 15 as shown in FIG. 1 or an intake chute may be provided at the bottom of the chamber 12.

Also contained in the chamber 12 are a number of exit pipes 34 which allow for the passage of heated air and smoke therefrom to pass between the array of vertically arranged conduits 24 in the general direction of travel indicated in dash line configuration. The passage is thus in the direction of the lower collector 18. The flow is rightwardly and circumferentially through the collector 18 and finally upwardly through the exit pipe 20. At the same time, there is provided a free rapid flow of heated air in the direction of the arrows X upwardly into the dome 23 and finally to the hot air pipe 22 from which it is conveyed to distant parts of the building through suitable adjunct duct and piping arrangements.

It will thus be seen that the main passage of heated air comprises ambient air introduced from a low level proximate the floor below the furnace 8 into the lower ends of the conduits 24*b*, upwardly through the conduits 24 and finally exiting through the upper ends 24*a* into dome 23 and thence into the general hot air distribution system. The flow of air induced through this system is such that there is required no auxiliary unit, such as a fan, to promote the upward flow of the heated air to the remote parts of the building. In this manner it is possible to greatly simplify the entire heating system and, accordingly, to reduce its overall cost of installation and even more importantly to lower its cost of operation.

As further shown in FIG. 3, there is provided a damper 35 at its upper right hand corner to selectively open and close a channel 36 provided between the hot air dome 23 and the hot air exit pipe 20. Normally, the damper will be operated to leave the channel pipe 36 open when the entire heating system is relatively cold.

Figure 4:
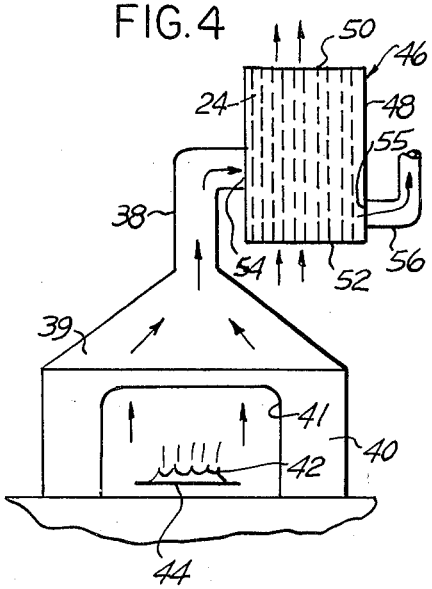
FIG. 4 is a fragmentary front elevational view of an alternate embodiment of the present invention.

FIG. 4 shows an alternate embodiment of the present invention in which the inventive heat exchange enclosure unit 46 is incorporated in the hot air output pipe 38 extending from the collector dome 39 of a fireplace 40. In this case, the primary combustion chamber, previously illustrated as chamber 12 in FIG. 3, is the actual burning chamber of the fireplace 40. The fuel being burned, in this case a solid fuel 42, is suitably supported on a grate 44 and the free passage of ambient air from the front of the front opening 41 of the fireplace 40 promotes combustion of the fuel. There is thus provided in the direction of the solid arrows the passage of heated air mixed with smoke and other noxious gases. The upper outlet pipe 38 passes this heated air stream from the fireplace 40 into the enclosure 46 having sidewalls 48, upper lid 50 and lower lid 52. Again a plurality of conduits 24 are held in a spaced array inside the enclosure 46. The connection to the pipe 38 is through a port 54 at the left hand side of the enclosure 46 and the outlet therefrom is provided through the port 55 to a hot air exit pipe 56 that is laterally spaced from and preferably somewhat below the inlet port 54. In a like manner to the operation already explained in connection with FIG. 3, heated air is provided from the central combustion chamber which comprises the fireplace 40 and the mixture of hot gases, smoke and the like are passed in a stream through the enclosure 46, between the spaced array of conduits 24 and finally to the exit pipe 56 from which it is finally communicated to an exit pipe and chimney. Again, there is provided a rapid and efficient flow of air from the bottom open ends of the conduits 24 and outwardly through the upper ends of the conduits 24, with a heated air flow provided in each case from the upper ends of the conduits 24.

Figure 5:
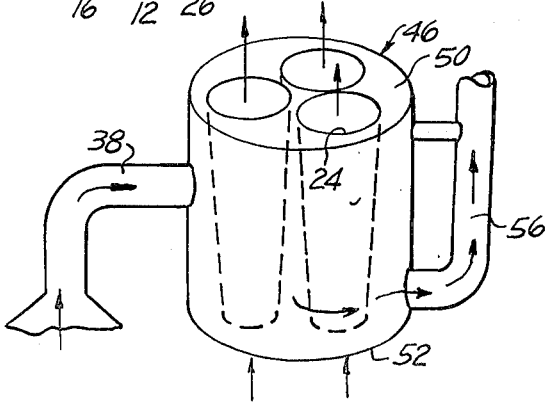
FIG. 5 is a further view with parts broken away showing a still further construction of the enclosure unit of the embodiment of FIG. 4.

FIG. 5 is an alternate embodiment of the showing of FIG. 4 with special modifications to the conduits 24 and with particular respect to the formation of the internal channels of the conduits. In a like manner to the FIG. 4 showing, the general enclosure unit is denoted by the numeral 46 and includes an upper lid 50 and a lower lid 52. The conduits 24 are likewise spaced one from the other and held in a rigid fashion between the upper lid 50 and the lower lid 52. The conduits 24, however, are shaped with their internal channels of a flared shaping, diverging upwardly to further promote the rapid flow of clean, heated ambient air therethrough as the hot air is passed through the inlet pipe 38 and out through the hot air exit pipe, again in the manner shown by the solid arrows.

FIG. 6 shows a top view of a still further embodiment of the present invention which provides for a separately built adjunct unit 80 which typically may be wheeled into operating position relative to a fireplace 82. The normal outline of such a fireplace 82 is shown by a dot-dash line 84 indicating the front of the fireplace. A plurality of flared openings conforming with conduits 24 for example of the FIG. 5 embodiment are included with their tops having a selectively adjustable group of louvers 25 formed at the top of the adjunct 80. A further flat lid portion 82 is shown in the drawing. There is included extending into the fireplace 82 an inwardly tapered hood 86 which has extending upwardly through it a pair of smoke exit pipes 88 as shown. Each of such pipes 88 extends downwardly and has a lower opening 90 in communication with the bottom of the enclosure 46 as will be better seen from the showing of FIG. 7. Each of such conduits 24 has an upper exit portion which is larger than the lower entrance portion 25. Further, each of the smoke exit pipes 88 extends upwardly through the hood 86 and thence into the chimney associated with the fireplace 82, not shown. It will be understood that the basic construction of each such chimney and fireplace 82 is well known to those skilled in the art.

With reference to FIG. 7, the adjunct unit 80 for the fireplace 82 is slidable into operating position upon a plurality of casters or spacers 91 mounted at both sides of the adjunct unit 80. While the conduits 24 are illustrated as being four in number, my invention is not so limited but may include any of a selected number of conduits required to give the desired heating capability to the adjunct 80. The general circulation of heated air taken in from points proximate the floor level is illustrated by a plurality of arrows H in a manner associated with each of the four heating conduits 24. The general path of smoke from the heating chamber of the fireplace 82 is further illustrated in FIG. 8 in which the fireplace combustion chamber and burning fuel are generally indicated by the numeral 92. While the air to be heated generally comes into the tubes 24 at floor level and exits in the manner shown by arrows H, the smoke from the lower surface of the hood 86 passes as shown into the enclosure 46 and thence downwardly as indicated by the arrows S. The final course of the smoke is upwardly through the smoke exit pipes 88 and finally through the chimney associated with the fireplace in a manner which is well known in the art. A damper 87 is included as shown.

It will thus be seen that the alternate embodiment illustrated in FIGS. 6–8 discloses an enclosure with flared conduits 24 having an operation substantially similar to that described for the embodiments in the preceding five figures. Certain advantages adhere to the embodiment at FIGS. 6–8 in that the adjunct is readily accommodated by any of a number of standard sized fireplace openings. While the primary combustion chamber 92 is that which is normally situated within the fireplace all the remaining operational and heating sequences of the system remain the same as previously described.

It will thus be seen that the present invention involves in one case an arrangement of the elements of the heat exchange enclosure unit in conjunction with a standard hot air furnace. In an alternate embodiment, a separate enclosure is provided which is adapted to be joined in the piping system for exiting hot air from any of a plurality of different primary combustion chambers, whether these be space heaters, stoves or fireplaces. Extensive advantages are derived from providing an increased flow of heated air independently of any external force, such as fan induced air flow. In this manner the efficiency of the heating system is greatly amplified.

It will thus be seen that by my invention I have provided a substantially improved heating system not taught, available from, nor disclosed by the prior art.

I claim:

1. A heating system adjunct unit for the use in conjunction with a standard fireplace having a wall inset portion including a combustion chamber comprising:

an enclosure positioned forwardly of said wall inset portion proximate said chamber and having an inlet for receiving heated gas from said chamber;

an outlet further connected and constructed in said enclosure vertically and laterally spaced from said inlet in said enclosure for receiving heated gas and smoke therefrom and passing it upwardly to ambient air; and a plurality of substantially vertically spaced conduits held in an array and extending through said enclosure for receiving relatively cold air at their lower openings thereof and exhausting heated air from the upper openings thereof, said conduits held in said array and spaced one from the other to permit passage of the heated gas and smoke therebetween in its path intermediate said inlet and said outlet.

2. The combination as set forth in claim 1 wherein each of said conduits includes at its upper opening a louver set for controlling the flow of heated air therefrom.

3. The combination as set forth in claim 1 wherein said adjunct unit includes at the base of said enclosure a plurality of spacer elements for allowing clearance for input of relatively cold air at the lower openings of said conduits proximate the floor.

4. The combination as set forth in claim 1 wherein said conduits are of an upward flaring configuration to expedite the flow of heated air between the respective lower and upper openings of said conduits.

* * * * *